US005244589A

United States Patent [19]

Liu et al.

[11] Patent Number: 5,244,589

[45] Date of Patent: Sep. 14, 1993

[54] ANTIMICROBIAL LUBRICANT COMPOSITIONS INCLUDING A FATTY ACID AND A QUATERNARY

[75] Inventors: Chung-Tsing Liu, Bloomington; Joseph C. Dirksen, St. Paul, both of Minn.

[73] Assignee: Ecolab Inc., St. Paul, Minn.

[21] Appl. No.: 642,056

[22] Filed: Jan. 16, 1991

[51] Int. Cl.[5] ..... C10M 173/00

[52] U.S. Cl. ..... 252/34; 252/49.3; 252/50; 252/56 R

[58] Field of Search ..... 252/49.3, 34

[56] References Cited

U.S. PATENT DOCUMENTS

| | | | |
|---|---|---|---|
| 3,148,747 | 9/1964 | Batchelor | 184/15.1 |
| 3,170,539 | 2/1965 | Snay et al. | 184/15.1 |
| 3,336,225 | 8/1967 | Sayad et al. | 252/34.7 |
| 3,576,234 | 4/1971 | Batchelor | 184/15.1 |
| 3,583,914 | 6/1971 | Garvin et al. | 252/34.7 |
| 3,766,068 | 10/1973 | Tesdahl et al. | 252/33.2 |
| 3,860,521 | 1/1975 | Aepli et al. | 252/34.7 |
| 4,289,636 | 9/1981 | Davis et al. | 252/49.3 |
| 4,342,596 | 8/1982 | Conner, Sr. | 252/392 |
| 4,547,303 | 10/1985 | Deck et al. | 252/34 |
| 4,824,586 | 4/1989 | Johnson et al. | 252/49.5 |
| 4,828,735 | 5/1989 | Minagawa et al. | 252/49.3 |
| 4,828,737 | 5/1989 | Sandberg et al. | 252/49.3 |
| 4,839,067 | 6/1989 | Jansen | 252/49.3 |
| 4,895,668 | 1/1990 | Singh et al. | 252/34 |
| 4,929,375 | 5/1990 | Rossio et al. | 252/49.3 |
| 5,062,978 | 11/1991 | Weber et al. | 252/49.3 |

FOREIGN PATENT DOCUMENTS

| | | |
|---|---|---|
| 70188/91 | 10/1991 | Australia . |
| 0044458 | 1/1982 | European Pat. Off. . |
| 0233774 | 8/1987 | European Pat. Off. . |
| 0372628 | 6/1990 | European Pat. Off. . |
| 0384282 | 8/1990 | European Pat. Off. . |
| 0445525A1 | 9/1991 | European Pat. Off. . |
| 2-55794 | 6/1990 | Japan . |
| 90/10053 | 9/1990 | PCT Int'l Appl. . |
| 90/50919 | 7/1991 | PCT Int'l Appl. . |

OTHER PUBLICATIONS

*The Merck Index*, Eleventh Edition, 1989, p. 2095.

*Disinfection, Sterilization, and Preservation*, Fourth Edition, Seymour S. Block, 1991, pp. 228, 248, 249, 274, 275.

*Inhibition and Destruction of the Microbial Cell*, Ed. W. B. Hugo, pp. 636–639, 675 and 685.

*Recent Developments in the Technology of Surfactants*, Critical Reports on Applied Chemistry, vol. 30, 1990, pp. 65–73.

*Chlorhexidine*, Chapter 16, G. W. Denton, pp. 274–275.

*Primary Examiner*—Ellen M. McAvoy

*Attorney, Agent, or Firm*—Merchant, Gould, Smith, Edell, Welter, & Schmidt

[57] ABSTRACT

Stable concentrated liquid and solid antimicrobial lubricating compositions can be formulated which include (−) 5 to 40 wt % of a $C_{6-24}$ fatty acid, (−) 10 to 40 wt % of a quaternary ammonium salt, (−) an amount of an alkaline source sufficient to increase the pH of the composition to at least 8, and optionally (−) about 0.1 to 10 wt % of an amine. The balance of the liquid form of the composition constitutes water. The lubricating compositions are particularly useful on the load bearing surfaces of conveyor belts used in food preparation where a combination of effective lubricity and efficacious antimicrobial activity are necessary.

29 Claims, No Drawings

ANTIMICROBIAL LUBRICANT COMPOSITIONS INCLUDING A FATTY ACID AND A QUATERNARY

FIELD OF THE INVENTION

The invention relates to lubricant compositions and more particularly to antimicrobial lubricant compositions adapted for use as a lubricating and antimicrobial compound on the load bearing surfaces of a chain driven conveyor system used in the packaging of foods.

BACKGROUND OF THE INVENTION

Beverages and other comestibles are often processed and packaged on mechanized conveyor systems which are lubricated to reduce friction between the packaging and the load bearing surface of the conveyor. The lubricants commonly used on the load bearing surfaces of these conveyor systems, such as those used in the food processing, beverage and the brewery industries, typically contain fatty acid soaps as the active lubricating ingredient because of the superior lubricity provided by fatty acid soaps.

In addition to lubricants, conveyor systems used in the processing and packaging of comestibles are also commonly treated with an antimicrobial compound, particularly the moving portions of the conveyor system likely to carry a residue of a food substance, such as the load bearing surface, in order to reduce the population of microorganisms, such as bacteria, yeast and mold, which tend to grow on the system and produce slime. Unfortunately, those antimicrobial compounds found to be particularly effective for controlling microbiological populations on a conveyor system are difficult to combine with fatty acid soaps because many of these antimicrobial compounds are deactivated by the anionic fatty acids. For example, cationic quaternary ammonium compounds, which are widely recognized for their antimicrobial activity, are not generally employed as an antimicrobial compound on conveyor systems because they tend to be deactivated by the anionic fatty acid soaps used as the lubricant on such systems. Furthermore, combinations of a quaternary ammonium compound and a fatty acid soap are not typically employed because quaternary ammonium salts and fatty acids are known to be generally physically incompatible. However, because of their effectiveness as an antimicrobial compound, quaternary ammonium salts have been employed in lubricating compositions which are fatty acid free.

Davis et al., U.S. Pat. No. 4,289,636, disclose an aqueous lubricant useful in metal cutting fluids for assisting in the care and cleaning of ferrous and cupreous metal surfaces, which comprises a water soluble amide derived from the reaction of a primary alkylamine or a secondary alkylamine with a member selected from the group of succinic, tetrahydrophthaleic or tetrahydrofuran tetracarboxylic acids. Davis et al. further disclose that the composition may also include a germicidal compound such as a quaternary compound including a $C_{12-16}$ alkyl group.

Jansen, U.S. Pat. No. 4,839,067 discloses a process for the maintenance of chain-type bottle conveyor belts which includes treating the conveyor belt with a lubricant composition containing a lubricating amount of a $C_{12-18}$ primary fatty acid amine with periodic treatment of the conveyor belt with an antimicrobial composition, such as an organic acid. However, such fatty acid free lubricant compositions have generally proven to be less effective for lubricating load bearing surface of a conveyor system as those which include a fatty acid.

While generally effective for controlling microbe populations, such fatty acid free lubricant compositions have generally proven to be less effective for lubricating the load bearing surface of a conveyor system than those which include a fatty acid.

Accordingly, while various attempts have been made to produce a microbiologically effective conveyor lubricating composition which provides both effective lubricity and effective microbiological action, such compositions have not generally been effective for providing both properties and a substantial need still exists for a conveyor lubricant which provides a combination of superior lubricity and superior antimicrobial activity.

SUMMARY OF THE INVENTION

The invention resides in a composition effective as both a lubricant and an antimicrobial compound and a method for the lubrication of the load bearing surfaces on a conveyor system using the antimicrobial lubricant composition. The antimicrobial lubricant composition may be formed as a liquid or solid concentrate and includes (i) an effective lubricating amount of a $C_{6-24}$ fatty or carboxylic acid having the formula $R^{10}COOH$ wherein $R^{10}$ is a hydrophobic aliphatic group having from about 5 to about 23 carbon atoms, (ii) an effective antimicrobial amount of a water soluble cationic quaternary ammonium antimicrobial compound having the formula $(R^1)(R^2)(R^3)(R^4)N^+X^-$ wherein $R^1$, $R^2$, $R^3$, and $R^4$ are independently benzyl, $C_{1-24}$ alkyl benzyl, halo benzyl, $C_{1-24}$ alkyl, or $C_{1-4}$ hydroxyalkyl, and $X^-$ represents an anion capable of imparting water solubility or dispersibility to the quaternary compound, and (iii) a major portion of water. The lubricant is preferably formulated by combining a fatty acid mixture and a water soluble quaternary ammonium salt with the addition of water when the lubricant concentrate is to be in liquid form.

The preferred antimicrobial lubricant compositions of the invention combine, in an alkaline aqueous medium (pH> 8) (i) an effective lubricating amount of a $C_{6-24}$ fatty acid, (ii) an effective antimicrobial amount of a quaternary ammonium chloride, and (iii) an effective lubricating and/or antimicrobial enhancing amount of an amine. The further preferred formulations of the antimicrobial lubricant compositions of the invention include, in an alkaline aqueous system containing an alkaline alkali metal salt, (i) an effective lubricating amount of a $C_{8-20}$ fatty acid, (ii) an effective antimicrobial amount of an alkyl dimethyl benzyl quaternary ammonium chloride, (iii) an effective lubricating and/or antimicrobial enhancing amount of an antimicrobial amine, and (iv) a hardness sequestering agent. Any of these lubricant formulas can also include a hydroxy compound and/or a nonionic surfactant. The antimicrobial lubricant formulations of the invention may also include those additives typically employed in such compositions including foam suppressants, viscosity control agents, dyes, etc.

The lubricant formulations of the invention have excellent antimicrobial, cleaning, and lubricity properties and provide a significant improvement in reducing friction and increasing microbial kill efficacy in comparison to prior antimicrobial lubricants. The lubricant compositions of the invention keep the load bearing surfaces of a conveyor system, including the conveyer chain surfaces, clean and lubricated while simultaneously reducing the population of micro-organisms on the conveyor system, including the chain drive surfaces, to a level effective for preventing slime growth on the system. The lubricant formulations of the invention successfully combine a fatty acid and a cationic quaternary compound, resulting in a composition having excellent lubricating properties, phase and chemical stability, and antimicrobial activity.

DETAILED DESCRIPTION OF THE INVENTION

As utilized herein, including the examples and claims, the terms "sanitize" and "sanitizing" are used as defined by the Environmental Protection Agency in the publication "Pesticide Assessment Guidelines" at subdivision G: Product Performance 1982, §91-2(j)2. Accordingly, sanitization occurs only when at least a 5 log reduction is achieved in the number of test micro-organisms in comparison to a parallel control count.

The invention resides in an improved antimicrobial lubricant concentrate composition that can be formulated in liquid or solid form. The antimicrobial lubricant composition comprises (i) an effective lubricating amount of $C_{6-24}$ fatty carboxylic acid having the formula RCOOH wherein R is an aliphatic group, preferably alkyl, having from about 5 to about 23 carbon atoms; (ii) an effective antimicrobial amount of a water soluble cationic quaternary ammonium antimicrobial compound having the formula $(R^1)(R^2)(R^3)(R^4)N^+X^-$ wherein $R^1$, $R^2$, $R^3$, and $R^4$ are independently benzyl, $C_{1-24}$ alkyl benzyl, halo benzyl, $C_{1-24}$ alkyl, or $C_{1-4}$ hydroxyalkyl, and $X^-$ represents an anion capable of imparting water solubility or dispersibility to the quaternary compound; and (iii) the balance of the composition, when formed as a liquid, is water. The composition may also include various optional components intended to enhance lubricity, antimicrobial efficacy, hard water tolerance, physical and/or chemical stability, etc. The antimicrobial lubricant composition of the invention is particularly well suited for lubricating and controlling microbial populations on the load bearing surfaces and drive chains of conveyor systems, particularly those used in the food processing, brewery and beverage industries.

Carboxylic Acids

A wide variety of carboxylic acids may be usefully employed in the antimicrobial lubricant compositions of the invention. Those acids found to provide effective lubricity are those having the general formula RCOOH wherein R represents an aliphatic group having from about 5 to about 23 carbon atoms (fatty acids having about 6 to 24 carbon atoms). For use in formulating the solid form of the composition the $C_{8-24}$ fatty acids are preferred as they assist in solidification of the composition. The aliphatic group may be branched or unbranched and saturated or unsaturated but is preferably a straight chain alkyl group. Preferred carboxylic acids include the $C_{10-18}$ fatty acids and mixtures thereof.

Referring to Tables One and Four, it appears that those antimicrobial lubricant compositions of the invention employing only lower fatty acids (less than about 14 carbon atoms) provide better antimicrobial action while those employing a higher fatty acid (greater than about 16 carbon atoms), either alone or in combination with a lower fatty acid, provide better lubricity.

Specific examples of suitable carboxylic acids include such saturated fatty acids as enanthic (heptanoic) ($C_7$), caprylic (octanoic) ($C_8$), pelargonic (nonanoic) ($C_9$), capric (decanoic) ($C_{10}$), undecyclic (undecanoic) ($C_{11}$), lauric (dodecanoic) ($C_{12}$), trideclic (tridecanoic) ($C_{13}$), myristic (tetradecanoic) ($C_{14}$), palmitic (hexadecanoic) ($C_{16}$), stearic (octadecanoic) ($C_{18}$), arachidic (eicosanoic) ($C_{20}$), behenic (docosanoic) ($C_{22}$), and lignoceric (tetracosanoic) ($C_{24}$); monounsaturated fatty acids such as lauroleic ($C_{12}$), myristoleic ($C_{14}$), palmitoleic ($C_{16}$), oleic ($C_{18}$), gadoleic ($C_{20}$), and brassidic ($C_{22}$); polyunsaturated fatty acids such as linoleic (di-unsaturated $C_{18}$), and linolenic (tri-unsaturated $C_{18}$); and substituted fatty acids such as ricinoleic (hydroxy-substituted $C_{18}$), etc.

Mixed fatty acids may be employed in the antimicrobial lubricant composition of the invention such as those derived from fats and oils. Coconut oil fatty acids are particularly preferred in the antimicrobial lubricant compositions of the invention because of their ready availability and superior lubricating properties. Coconut oil fatty acids include major fractions of lauric and myristic acids and minor fractions of palmitic, stearic, oleic and linoleic acids. Tall oil fatty acids, obtained as a byproduct of the paper industry from the tall oil recovered from pine wood black liquor, are also preferred fatty acids for use in the antimicrobial lubricant composition of the invention. Tall oil fatty acids include major fractions of oleic and linoleic acids and minor fractions of palmitic, stearic, and isostearic acids.

Cationic Antimicrobial Compounds

The cationic antimicrobial compound used in the antimicrobial lubricant compositions of the invention contributes effective antimicrobial or germicidal action to the composition by reducing microbe populations. Generally, the cationic antimicrobial compound should be susceptible to dissolution or dispersion in an aqueous medium without significant degradation, precipitation, and/or phase separation over extended periods of time when used in the composition.

A wide variety of effective cationic antimicrobial compounds may be incorporated into the antimicrobial lubricant composition of the invention without inducing undesirable physical or chemical interactions between the major components of the composition. The preferred antimicrobial compounds are the highly effective quaternary ammonium compounds having the formula $(R^1)(R^2)(R^3)(R^4)N^+X^-$ wherein $R^1$, $R^2$, $R^3$, and $R^4$ are independently a $C_{1-24}$ aliphatic group, a $C_{1-4}$ hydroxyaliphatic group, benzyl, $C_{1-24}$ alkyl benzyl, or halo benzyl, and $X^-$ represents an anion capable of imparting water solubility or dispersibility to the compound such as chloride, bromide, iodide, sulfate, methylsulfate, and others. This anion is linked to the nitrogen through an electrovalent bond.

The hydrocarbon substituents $R^1$, $R^2$, $R^3$, and $R^4$ may be alike or different, substituted or unsubstituted, branched or unbranched, and saturated or unsaturated. In somewhat greater detail, the hydrocarbon substituents $R_1$, $R^2$, $R^3$, and $R^4$ may be independently selected from hydrocarbon groups including specifically, but not exclusively: lower alkyl groups such as methyl, ethyl, propyl and butyl; higher alkyl groups such as pentyl, hexyl, heptyl, 2-ethylhexyl, octyl, isooctyl, nonyl, decyl, unidecyl, dodecyl, tetradecyl, and eicosyl; substituted lower alkyl groups such as hydroxyethyl and hydroxypropyl; lower alkenyl groups such as ethenyl, propenyl, and butenyl; lower alkynyl groups such as ethynyl, propynyl, and butynyl; cycloalkyl groups such as cyclohexyl; aryl groups such as benzyl, phenyl and naphthyl; and aralkyl/alkaryl groups such as tolyl, xylyl, alkyl substituted benzyl, and alkylnaphthyl.

Several theories have been proposed to explain the mechanism by which the quaternary ammonium compounds are able to deactivate microorganisms such as bacteria. One theory suggests that the bactericidal effect is achieved because of the ability of quaternary ammonium compounds to chemically disrupt continuity of the cell walls of the microorganism and thereby cause a release of the cell contents into the surrounding medium. A second theory suggests that quaternary ammonium compounds interact with the cell walls of the microorganism and interfere with the metabolic processes of the organism so as to starve the microorganism. Whatever the exact mechanism, experience suggests that the antimicrobial action is closely related to the surface activity of the quaternary ammonium compound.

It is a well recognized principle that the surface activity of a compound in an aqueous environment is effected by the presence of both a hydrophilic and a hydrophobic moiety on the compound. Since quaternary ammonium compounds are inherently hydrophilic in nature due to their cationic structure, the amphipathy characteristic of the compound must be achieved by providing at least one pendant hydrocarbon group which is effective for providing a hydrophobic group on the compound.

While several factors can affect the overall antimicrobial performance of the quaternary ammonium compound such as the other components present in the antimicrobial lubricant composition and the particular microbes present, optimum antimicrobial activity appears to occur when the hydrocarbon substituents on the quaternary ammonium compound contain about 16 carbon atoms.

Generally speaking, completely aliphatic quaternary ammonium compounds appear to provide optimal antimicrobial activity when the largest aliphatic group is a straight chain $C_{16-18}$ group and benzyl quaternary ammonium compounds appear to provide optimal antimicrobial activity when the largest aliphatic group is a straight chain $C_{14}$ group.

A large variety of surface active quaternary ammonium salts are useful as the antimicrobial compound in the antimicrobial lubricant compositions of the invention including the commonly available tetraalkyl quaternary ammonium chlorides, trialkyl benzyl quaternary ammonium chlorides and trialkyl alkylbenzyl quaternary ammonium chlorides all having a largest aliphatic group having about 12 to about 16 carbon atoms. Neat concentrations of these quaternary ammonium chlorides are generally viscous liquids but usually sold as aqueous solutions.

Preferred quaternary ammonium salts which can be used as the antimicrobial compound in the antimicrobial lubricant compositions of the invention include specifically, but not exclusively, $(C_{8-24})$alkyl-trimethyl quaternary ammonium salts such as hexadecyl-trimethyl quaternary ammonium chloride and octadecyl-trimethyl quaternary ammonium chloride; $(C_{8-24})$dialkyl dimethyl quaternary ammonium compounds such as didecyl-dimethyl quaternary ammonium chloride; alkyl-aryl quaternary ammonium salts such as $(C_{8-24})$alkyl-dimethyl-benzyl quaternary ammonium chloride, $(C_{8-24})$alkyl-dimethylbenzalkonium chloride, and dimethyl-dichlorobenzyl quaternary ammonium chloride; and various others such as hexadecyl-pyridinium chloride, benzethonium chloride and methylbenzethonium chloride.

Highly preferred quaternary ammonium compound for use in the antimicrobial lubricant compositions of the invention are the $(C_{8-24})$alkyl-dimethyl-benzyl quaternary ammonium chlorides having the general formula:

$$(C_6H_5CH_2)(CH_3)_2(R^1)N^+Cl^-$$

wherein $R^1$ is a $C_{6-24}$ alkyl.

Particularly preferred is a mixture of $(C_{8-18})$alkyl-dimethyl-benzyl quaternary ammonium chlorides having predominately (i.e. more than 50 mole %) $C_{12}$ alkyl groups.

Other Components

Water

When the antimicrobial lubricant composition of the invention is formulated as a liquid the composition includes a major portion of water in addition to the fatty acid and quaternary ammonium compound.

Alkaline Source

The antimicrobial lubricant composition includes a source of alkalinity sufficient to increase the pH of the composition, and any use solution prepared from the composition, above about 8. At pHs of less than about 8 the carboxylic acid component of the composition tends to separate from the other components and form soap curds, particularly when dispensed into hard water. In addition, the antimicrobial efficiency of the quaternary ammonium compounds generally increases with increasing pH.

The source of alkalinity may be conveniently selected from any compatible alkaline compound. A nonexhaustive list of suitable sources of alkalinity includes ammonia and ammonium hydroxide; alkali metal hydroxides such as sodium hydroxide and potassium hydroxide; amino compounds such as monoethanolamine, diethanolamine, and triethanolamine; and alkali metal silicates such as sodium metasilicate and sodium orthosilicate. Based upon compatibility with the other components, ability to preform as an effective source of alkalinity, and ability to enhance the lubricating property of the composition, the alkaline source of preference for use in the antimicrobial lubricant composition is triethanolamine.

Amine

We have surprisingly discovered that the inclusion of an amine compound into the antimicrobial lubricant compositions of the invention can significantly enhance both the antimicrobial and lubricating properties of the compositions (See Table Four). Suitable amines include specifically, but not exclusively, those having the general formula:

$$N(R^7)_3$$

wherein $R_7$ can be hydrogen, a $C_{1-20}$ aliphatic group, an aryl group, an alkaryl group, and various halo, nitro, sulfo, and hydroxyl substituted forms thereof. Representative examples of suitable amines include methyl amine, dimethyl amine, ethylene amine, diethylene amine, aniline, chloroaniline, morpholine, pyridine, 2-ethylhexyl amine, didodecyl amine, hydroxyethyl amine, dihydroxyethyl amine, trimethyl amine, diethyl methyl amine, dodecyl dimethyl amine, di(aminoethyl) dodecyl amine, etc.

Preferred amine compounds for use in the invention are diamines (secondary amines containing one amine substituent) having the general formula:

$$(R^8)NH(R^9)NH_2$$

wherein $R^8$ is a $C_{8-24}$ aliphatic group and $R^9$ is a $C_{1-20}$ alkylene group. Most preferably, $R_8$ is a $C_{12-20}$ alkyl group and $R_9$ is a $C_{1-5}$ alkylene. Examples of useful diamines represented by the general formula $(R^8)NH(CH_2)NH_2$ wherein $R^8$ is a $C_{10-24}$ aliphatic group includes N-coco-alkyl-trimethylene diamine, N-oleyl-alkyl-trimethylene diamine, N-tallow-alkyl-trimethylene diamine, etc.

Nonionic Surfactants

The antimicrobial lubricant compositions of the invention optionally, but preferably, may further include a compatible material for enhancing the lubricity of the composition, such as a nonionic surfactant.

Nonionic surfactants are generally hydrophobic compounds which bear essentially no charge and exhibit a degree of hydrophilic tendency due to the presence of ether oxygen in the molecule. Nonionic surfactants encompass a wide variety of polymeric compounds which include specifically, but not exclusively, ethoxylated alkylphenols, ethoxylated aliphatic alcohols, carboxylic esters, carboxylic amides, and polyoxyalkylene oxide block copolymers.

Particularly suitable nonionic surfactants for use in the antimicrobial lubricant composition of the invention are those having the general formula $$R^5B_nOR^6$$

wherein $R^5$ is an alkyl, aryl or alkaryl group having from about 8 to about 24 carbon atoms; B represents an oxy($C_{2-4}$)alkylene group (—O-alkylene-); $R^6$ is hydrogen, a $C_{1-4}$ alkyl group, or an aryl group; and n is a number from 1 to 20 which represents the average number of oxyalkylene groups on the molecule.

Preferred nonionic surfactants of this formula include specifically, but not exclusively, polyalkylene oxide alkoxylates such as an alkyl propoxylate; ethoxylated alcohols such as octyl alcohol ethoxylate, decyl alcohol ethoxylate, dodecyl alcohol ethoxylate, tetradecyl alcohol ethoxylate, and hexadecyl alcohol ethoxylate; and alkoxylates of oxo alcohols having from about 9 to 17 carbon atoms. Based upon their ability to enhance the lubricity and cleansing effect of the antimicrobial lubricant composition at a reasonable cost, a particularly preferred group of nonionic surfactants are nonylphenol ethoxylates (NPE) having an average of about 5 to 10 moles of ethylene oxide per molecule.

Sequestrant

The antimicrobial compositions of the invention may also optionally contain a sequestrant for the purpose of complexing or chelating hardness components in the service water into which the antimicrobial lubricant composition is dispensed. Sequestrants are reagents that combine with metal ions to produce soluble complexes or chelate compounds. The most common and widely used sequestrants are those that coordinate metal ions through oxygen and/or nitrogen donor atoms. The sequestrant used in the antimicrobial lubricant composition of the invention may be organic or inorganic so long as it is compatible with the other components of the composition. Based upon availability and overall compatibility with the other components, the preferred sequestrant is ethylenediamine tetraacetic acid.

Alcohol

The novel antimicrobial lubricant compositions of the invention may also contain a ($C_{1-10}$) alcohol having about 1-5 hydroxy groups for the purpose of enhancing the physical stability, wettability, and antimicrobial activity of the composition. A nonexhaustive list of suitable alcohols include methanol, ethanol, isopropanol, t-butanol, ethylene glycol, propylene glycol, hexylene glycol, glycerine, low molecular weight polyethylene glycol compounds, and the like.

Other Components

In addition to the above mentioned components, the antimicrobial lubricating compositions of the invention may also contain those components conventionally employed in conveyor lubricant compositions, which are compatible in the composition, to achieve specified characteristics such as anti-foam additives, viscosity control agents, perfumes, dyes, corrosion protection agents, etc.

Concentration

Broadly, the solid and liquid forms of the concentrated antimicrobial lubricant compositions of the invention should include about 5 to 40 wt-% lubricating carboxylic acid and about 5 to 20 wt-% antimicrobial quaternary ammonium compound. More specifically, the liquid form should include about 5 to 30 wt-% lubricating carboxylic acid and about 5 to 15 wt-% antimicrobial quaternary ammonium compound in an aqueous base while the solid form should include about 25 to 40 wt-% lubricating carboxylic acid and about 7 to 15 wt-% antimicrobial quaternary ammonium compound.

A preferred liquid concentrate of the antimicrobial lubricant composition of the invention includes about 5-30 wt-% coconut oil fatty acids, about 0-15 wt-% (most preferably about 0.1-10 wt-%) tall oil fatty acids, about 5-15 wt-% of a tetra-alkyl quaternary ammonium chloride, a sufficient amount of a source of alkalinity to produce a pH of greater than about 8.5 (generally about 0-15 wt-%), about 0-25 wt-% (most preferably 0.1-16 wt-%) of a hydroxyalkyl amine, about 0-15 wt-% (most preferably about 0.1-10 wt-%) of a nonionic surfactant, about 0-25 wt-% (most preferably about 0.1-15 wt-%) EDTA, about 0-15 wt-% (most preferably 0.1-10 wt-%) of a $C_{1-10}$ alcohol, and the balance water.

A preferred solid concentrate of the antimicrobial lubricant composition of the invention includes about 5-40 wt-% coconut oil fatty acids, about 0-15 wt-% (most preferably about 0.1-10 wt-%) tall oil fatty acids, about 5-15 wt-% of a tetra-alkyl quaternary ammonium chloride, a of greater than about 8.5 (generally about 0-20 wt-%), about 0-25 wt-% (most preferably 0.1-15 wt-%) of a hydroxyalkyl amine, about 0-15 wt-% (most preferably about 0.1-10 wt-%) of a nonionic surfactant, about 0-25 wt-% (most preferably about 0.1-15 wt-%) EDTA, and about 0-15 wt-% (most preferably 0.1-10 wt-%) of a $C_{1-10}$ alcohol.

The liquid and solid forms of the antimicrobial lubricant compositions of the invention are conveniently dispensed by diluting a portion of the composition immediately prior to use with sufficient water to form a use solution which may then be sprayed upon the surface to be lubricated.

The liquid form of the concentrated antimicrobial lubricant composition may be conveniently formed by mixing the water and carboxylic acid to form a lubricating premix and then adding the cationic antimicrobial compound to the lubricant premix. The other components may be added at any convenient stage of the processes.

The solid form of the concentrated antimicrobial lubricant composition may be conveniently formed by mixing the carboxylic acid and cationic antimicrobial compound under constant agitation and sufficient heat (if necessary) to form a liquid mixture and then incorporating the other components, still under constant agitation and sufficient heat to maintain liquidity (if necessary). Upon cessation of agitation and cooling the resultant mixture solidifies into a water soluble block of antimicrobial lubricant.

The antimicrobial lubricant compositions of the invention may be applied to the load bearing surface of a conveyor system by any of the well recognized methods for such application including the most commonly utilized and widely accepted practice of spraying the lubricant onto the moving conveyor surface. However, prior to dispensing the antimicrobial lubricant compositions of the invention onto the conveyor system, the composition must be diluted to use strength. The diluted antimicrobial lubricant use solution should contain about 100 to 2000 ppm (w/v), preferably about 200 to 1000 ppm (w/v), active antimicrobial lubricant components wherein the active components of the antimicrobial lubricant composition includes all of those components which contribute to the antimicrobial and/or lubricating efficacy of the composition, specifically excluding any water contained in the composition. Specifically, the diluted antimicrobial lubricant use solution should contain about 100–1000 ppm (w/v) fatty acid, (most preferably about 100–1000 ppm (w/v) coconut oil fatty acids and/or about 30–200 ppm (w/v) tall oil fatty acids), about 200–1000 ppm (w/v) of a tetra-alkyl quaternary ammonium chloride, about 50–350 ppm (w/v) of a nonionic surfactant, about 30–200 ppm (w/v) of a sequestrant, about 30–200 ppm (w/v) of an amine, and about 50–350 ppm (w/v) of an alcohol.

This description is provided to aid in a complete nonlimiting understanding of the invention. Since many variations of the invention may be made without departing from the spirit and scope of the invention, the breadth of the invention resides in the claims hereinafter appended.

EXAMPLES

Compositions

Example 1

A liquid antimicrobial lubricant was made by mixing the following ingredients in the order listed below.

| Ingredient | Weight % |
|---|---|
| Water | 13.00 |
| $Na_4$.EDTA (40% aqueous) | 8.00 |
| Coconut fatty acid | 15.00 |

-continued

| Ingredient | Weight % |
|---|---|
| Triethanol amine | 21.00 |
| $C_{10-16}$ alkyl-dimethyl-benzyl ammonium chloride (50% aq) | 20.00 |
| Hexylene glycol | 5.00 |
| Nonyl Phenol Ethoxylate (avg of 9.5 moles EO) | 5.00 |
| coco-trimethylene alkyldiamine | 3.00 |
| Potassium hydroxide (45% w/v aqueous) | 7.00 |
| Tall oil fatty acid | 3.00 |

Example 2

A solid antimicrobial lubricant was made by mixing the following ingredients in the order listed below.

| Ingredient | Weight % |
|---|---|
| Coconut fatty acid | 32.00 |
| Propylene glycol | 3.00 |
| Nonyl Phenol Ethoxylate (avg of 9.5 moles EO) | 10.00 |
| Triethanol amine | 16.00 |
| $C_{10-16}$ alkyl-dimethyl-benzyl ammonium chloride (50% Aq) | 22.00 |
| $Na_4$.EDTA (powdered) | 3.00 |
| Sodium Hydroxide (50% w/v aqueous) | 14.00 |

The mixture was conducive to processing and resulted in a rigid solid. An aqueous solution containing 0.5 wt % of the resultant composition had a pH of 10.58.

Antimicrobial and Lubricity Performance

Testing Procedure Antimicrobial Activity

Lubricant use solutions containing 0.5 wt % of the lubricant compositions having the component concentrations listed in the following Tables were prepared with sterile distilled water. One milliliter of the inoculum, prepared as set forth below, was combined with ninety-nine milliliters of the lubricant solution and swirled for 20 seconds. A one milliliter sample of the lubricant solution/inoculum mixture was removed after a 5 minute exposure time and added to nine milliliters of a sterile neutralizer solution containing asolectin and polysorbate 80 (a polyoxyethylene fatty acid ester). The neutralized sample was serially diluted with buffered water and plated in duplicate using tryptone glucose extract (TGE) agar. The procedure was repeated after fifteen, thirty, sixty, and two hundred forty minute exposure times. The plates were incubated at 37° C. for 48 hours.

Controls to determine initial inoculum were prepared by adding one milliliter of inoculum to ninety-nine milliliters of buffered water, serially diluting the mixture with additional buffered water, and plating with TGE.

BACTERIAL INOCULUM

The bacteria listed below were transferred and maintained on nutrient agar slants. Twenty-four hours prior to testing ten milliliters of nutrient broth was inoculated with a loopful of each organism, one tube per organism. The inoculated nutrient broth cultures were incubated at 37° C. Shortly before testing equal volumes of each incubated broth culture were mixed and used as the test inoculum.

ORGANISMS

*Pseudomonas aeruginosa* ATCC 15442.
*Staphylococcus aureus* ATCC 6538.
*Escherichia coli* ATCC 11229.

*Enterobacter aerogenes* ATCC 13048.

Testing Procedure

Lubricity

A string of six one-liter glass bottles weighing an average of about 1.44 kilograms were placed upon a chain-type conveyor system having a stainless steel load bearing surface and connected to a load cell. The lubricant composition to be tested was diluted with service water to a use concentration of 0.1 wt % and the pH of the use solution adjusted as desired by adding acetic acid or sodium hydroxide as necessary. The conveyor was operated at full speed (about 120 ft/min), the load bearing surface of the conveyor sprayed with the lubricant use solution at a rate of about 2,000 ml/hr, and the output of the load cell sampled and recorded every second by a computer. Lubricity was measured in terms of the tension generated by the bottles on the load cell.

TABLE ONE

| | Examples 3-5 | | | | | | |
|---|---|---|---|---|---|---|---|
| | $C_{12}$ | $C_{18}$ | Quat | Ratio | Log Reduction | | |
| Trial # | % | % | % | $C_{18}$/Quat | 30 min | 60 min | 240 min |
| 3 | 10 | 05 | 10 | 0.50 | 1.0 | 1.7 | 2.6 |
| 4 | 10 | 03 | 10 | 0.30 | 3.6 | 5.0 | 5.0 |
| 5 | 10 | 00 | 10 | 0.00 | 5.0 | 5.0 | 5.0 |

$C_{12}$ = a twelve carbon fatty acid
$C_{18}$ = an eighteen carbon fatty acid
Quat = $C_{10-16}$ alkyl-dimethyl-benzyl ammonium chloride TABLE TWO-continued

| | Examples 6-12 | | | | | |
|---|---|---|---|---|---|---|
| | $C_{12}$ | Quat | Ratio | Log Reduction | | |
| Trial # | % | % | $C_{12}$/Quat | 30 min | 60 min | 240 min |
| 11 | 15 | 20 | 0.75 | 5.0 | 5.0 | 5.0 |

$C_{12}$ = a twelve carbon fatty acid
Quat = $C_{10-16}$ alkyl-dimethyl-benzyl ammonium chloride Conclusion(s)

The ratio of fatty acid to quaternary ammonium chloride significantly affects antimicrobial efficacy with antimicrobial efficacy decreasing as the ratio of fatty acid to quaternary ammonium chloride increased.

TABLE THREE

| | Examples 12-14 | | | | | |
|---|---|---|---|---|---|---|
| Trial | | | | Log Reduction | | |
| # | Quat[1] | Quat[2] | Quat[3] | 30 min | 60 min | 240 min |
| 12 | 500 ppm | — | — | 4.6 | 4.5 | 5.0 |
| 13 | — | 500 ppm | — | 5.0 | 5.0 | 5.0 |
| 14 | — | — | 500 ppm | 5.0 | 5.0 | 5.0 |

Quat[1] = $C_{12-16}$ alkyl-dimethyl-benzyl ammonium chloride (40% $C_{12}$, 50% $C_{14}$, 10% $C_{16}$)
Quat[2] = dodecyl-dimethyl ammonium chloride
Quat[3] = $C_{12-16}$ alkyl-dimethyl-benzalkonium chloride (64% $C_{12}$, 30% $C_{14}$, 06% $C_{16}$)

Conclusion(s)

Significant antimicrobial activity can be achieved with a variety of quaternary compounds.

TABLE FOUR

| | Examples 15-21 | | | | | | | | |
|---|---|---|---|---|---|---|---|---|---|
| | | | | | | | Log Reduction | | |
| Trial # | $C_{12}$ % | $C_{18}$ % | Quat % | Amine[1] % | Amine[2] % | Lbrcty (grams) | 30 min | 60 min | 240 min |
| 15 | 15 | — | 20 | — | — | — | 5.0 | 5.0 | 5.0 |
| 16 | 15 | 03 | 20 | — | — | — | 1.7 | 1.9 | 2.2 |
| 17 | 15 | 03 | 20 | 03 | — | — | 3.3 | 4.1 | 5.0 |
| 18 | 15 | — | 10 | — | — | 1680 | 5.0 | 5.0 | 5.0 |
| 19 | 15 | — | 10 | — | 03 | 1317 | 5.0 | 5.0 | 5.0 |
| 20 | 15 | 03 | 10 | — | — | 1362 | 1.7 | 1.9 | 2.2 |
| 21 | 15 | 03 | 10 | — | 03 | 1044 | 4.1 | 5.0 | 5.0 |

$C_{12}$ = a twelve carbon fatty acid
$C_{18}$ = an eighteen carbon fatty acid
Quat = $C_{10-16}$ alkyl-dimethyl-benzyl ammonium chloride
Amine[1] = coco alkyl trimethylene diamine
Amine[2] = coco propylenediamine
Conclusion(s)
Inclusion of a fatty acid aliphatic diamine into the lubricating composition enhances both lubricity and antimicrobial efficacy regardless of the presence or absence of a $C_{18}$ fatty acid. The combination of a $C_{12}$ fatty acid, a quaternary ammonium chloride, a $C_{18}$ fatty acid, and a fatty acid aliphatic diamine provides the best combination of lubricity and antimicrobial efficacy.

Conclusion(s)

The combination of a $C_{12}$ fatty acid and a quaternary ammonium compound provides effective sanitization after only 30 minutes. Inclusion of a $C_{18}$ fatty acid into the composition reduces antimicrobial activity in proportion to the amount of the $C_{18}$ fatty acid employed.

TABLE TWO

| | Examples 6-12 | | | | | |
|---|---|---|---|---|---|---|
| | $C_{12}$ | Quat | Ratio | Log Reduction | | |
| Trial # | % | % | $C_{12}$/Quat | 30 min | 60 min | 240 min |
| 6 | 12 | 13 | 0.92 | 3.9 | 4.6 | 5.0 |
| 7 | 14 | 13 | 1.08 | 2.2 | 2.7 | 4.3 |
| 8 | 16 | 13 | 1.23 | 1.9 | 2.3 | 3.1 |
| 9 | 18 | 13 | 1.38 | 2.1 | 2.3 | 2.8 |
| 10 | 20 | 28 | 0.71 | 5.0 | 5.0 | 5.0 |

The foregoing discussion and examples are illustrative of the invention. However, since many embodiments of the invention can be made without departing from the spirit and scope of the invention, the invention resides wholly in the claims hereinafter appended.

We claim:

1. An alkaline concentrate which forms an aqueous antimicrobial lubricant composition upon dilution, said concentrate comprising:

(a) about 5-40 wt-% of a aliphatic monocarboxylic acid said carboxylic acid selected from the group consisting of lauric acid, coconut fatty acid, tall oil fatty acid, and mixtures thereof;

(b) about 5-20 wt-% of a water soluble quaternary ammonium salt having the formula $$(R^1)(R^2)(R^3)(R^4)N^+X^-$$

wherein $R^1$, $R^2$, $R^3$, and $R^4$ are independently selected from the group consisting of $C_{1-16}$ alkyl, $C_{1-4}$ hydroxyalkyl, benzyl, $C_{1-24}$ alkyl benzyl, and halo benzyl, and $X^-$ is an anion capable of imparting water solubility or water dispersibility to the quaternary ammonium salt;

(c) an amount of a source of alkalinity effective for neutralizing the monocarboxylic acid and increasing the pH of the concentrate above about 8; and (d) a balance of water wherein the lubricant is phase stable and chemically stable.

2. The concentrate of claim 1 wherein said quaternary ammonium salt is a $C_{10-16}$ alkyl-dimethyl-benzyl quaternary ammonium chloride.

3. The concentrate of claim 1 wherein said quaternary ammonium salt comprises about 5 to 15 wt-% of said concentrate.

4. The concentrate of claim 1 wherein said source of alkalinity is triethanolamine.

5. A liquid alkaline concentrate which forms an aqueous antimicrobial lubricant composition for the load bearing surface of a conveyor system upon dilution with water, said concentrate comprising:

(a) about 5–30 wt-% of an aliphatic monocarboxylic acid, said carboxylic acid selected from the group consisting of lauric acid, coconut fatty acid, tall oil fatty acid, and mixtures thereof;

(b) about 5–15 wt-% of a quaternary ammonium chloride;

(c) about 0.1–10 wt-% of an amine;

(d) about 0.1–25 wt-% of EDTA; and (e) the balance water wherein the lubricant is phase stable and chemically stable.

6. The concentrate of claim 5 further comprising an amount of a source of alkalinity effective for neutralizing the fatty acid and increasing the pH of the concentrate about about 8.

7. The lubricant composition of claim 5 wherein said quaternary ammonium chloride comprises a $C_{10-16}$ alkyl-dimethyl-benzyl quaternary ammonium chloride.

8. The lubricant composition of claim 5 wherein said amine comprises a diamine of the formula $$(R^1)(R^3)N(R^2)N(R^3)(R^3)$$

wherein:

$R^1$ is a $C_{8-24}$ aliphatic group, $R^2$ is a $C_{1-5}$ alkylene group, and $R^3$ is a $C_{1-20}$ aliphatic group or hydrogen.

9. The lubricant composition of claim 8 wherein said diamine comprises $(R^1)NH(CH_2CH_2CH_2)NH_2$ wherein $R^1$ is a $C_{12-20}$ alkyl group.

10. The lubricant of claim 8 wherein said sequestrant comprises ethylene diamine tetraacetic acid or sodium salt thereof.

11. A process for lubricating and reducing microbiological concentrations on the load bearing surface of a conveyor system comprising the steps of:

(a) dispersing an alkaline concentrate of an antimicrobial and lubricating composition into sufficient water to form an aqueous antimicrobial lubricating solution, wherein (i) said antimicrobial lubricating concentrate comprises an aliphatic monocarboxylic acid, said carboxylic acid selected from the group consisting of lauric acid, coconut fatty acid, tall oil fatty acid, and mixtures thereof and a water soluble quaternary ammonium compound, and (ii) said antimicrobial lubricating solution comprises at least about 100–2000 ppm (w/v) of at least one fatty acid, about 200–1000 ppm (w/v) of a water soluble quaternary ammonium salt, and a balance of water; and (b) placing said antimicrobial lubricating solution onto the load bearing surface of an operating conveyor system for a period of time effective to lubricate and reduce microbial populations on the load baring surface wherein the lubricant is phase stable and chemically stable.

12. The process of claim 11, wherein the lubricant has a pH of greater than 8.

13. The process of claim 11 wherein said quaternary ammonium salt comprises a tetra-alkyl quaternary ammonium chloride.

14. The process of claim 11 wherein said quaternary ammonium chloride comprises a $C_{10-16}$ alkyl-dimethyl-benzyl quaternary ammonium chloride.

15. A solid alkaline concentrate which forms an aqueous antimicrobial lubricant composition upon dilution, said concentrate comprising:

(a) about 5–30 wt-% of an aliphatic carboxylic acid, said carboxylic acid selected from the group consisting of lauric acid, coconut fatty acid, tall oil fatty acid, and mixtures thereof;

(b) about 5–15 wt-% of a water soluble quaternary ammonium salt having the formula $$(R^1)(R^2)(R^3)(R^4)N^+X^-$$

wherein $R^1$, $R^2$, $R^3$, and $R^4$ are independently selected from the group consisting of $C_{1-16}$ alkyl, $C_{1-4}$ hydroxyalkyl, benzyl, alkyl benzyl, and halo benzyl, and $X^-$ is an anion capable of imparting water solubility or water dispersibility to the quaternary ammonium salt; and (c) an amount of a source of alkalinity effective for neutralizing the monocarboxylic acid and increasing the pH of the concentrate above about 8 wherein the lubricant is phase stable and chemically stable.

16. The concentrate of claim 15 wherein said quaternary ammonium salt is a $C_{10-16}$ alkyl-dimethyl-benzyl quaternary ammonium chloride.

17. The concentrate of claim 15 wherein said quaternary ammonium salt comprises about 5 to 15 wt-% of said concentrate.

18. The concentrate of claim 15 wherein said source of alkalinity is triethanolamine.

19. A solid alkaline concentrate which forms an aqueous antimicrobial lubricant composition for the load bearing surface of a conveyor system upon dilution with water, said concentrate comprising:

(a) about 25–40 wt-% of an aliphatic monocarboxylic acid, said carboxylic acid selected from the group consisting of lauric acid, coconut fatty acid, tall oil fatty acid, and mixtures thereof;

(b) about 7–15 wt-% of a quaternary ammonium chloride;

(c) about 0.1–15 wt-% of an N-alkyl-alkylene diamine; and (d) about 0.1–25 wt-% of EDTA.

20. The concentrate of claim 15 further comprising an amount of a source of alkalinity effective for neutralizing the fatty acid and increasing the pH of the concentrate about about 8.

21. The lubricant composition of claim 19 wherein said quaternary ammonium chloride comprises a $C_{10-16}$ alkyl-dimethyl-benzyl quaternary ammonium chloride.

22. The lubricant composition of claim 19 wherein said amine comprises a diamine of the formula $$(R^1)(R^3)N(R^2)N(R^3)(R^3)$$

wherein:

$R^1$ is a $C_{8-24}$ aliphatic group, $R^2$ is a $C_{1-5}$ alkylene group, and $R^3$ is a $C_{1-20}$ aliphatic group or hydrogen.

23. The lubricant composition of claim 19 wherein said diamine comprises $(R^1)NH(CH_{2CH}2CH_2)NH_2$ wherein $R^1$ is a $C_{12-20}$ alkyl group.

24. A diluted antimicrobial lubricant solution for the load bearing surface of a conveyor system comprising:

(a) about 100–1000 ppm (w/v) coconut oil fatty acids;
(b) about 30–200 ppm (w/v) tall oil fatty acids;
(c) about 200–1000 ppm (w/v) of a tetra-alkyl quaternary ammonium chloride;
(d) about 50–350 ppm (w/v) of a nonionic surfactant;
(e) about 30–200 ppm (w/v) of a sequestrant;
(f) about 30–200 ppm (w/v) of an amine; and
(g) about 50–350 ppm (w/v) of an alcohol.

25. The antimicrobial lubricant solution of claim 24 further comprising an amount of a source of alkalinity effective for neutralizing the fatty acid and increasing the pH of the concentrate above about 8.

26. The antimicrobial lubricant solution of claim 24 wherein said tetra-alkyl quaternary ammonium chloride comprises a $C_{10-15}$ alkyl-dimethyl-benzyl quaternary ammonium chloride.

27. The antimicrobial lubricant solution of claim 25 wherein said nonionic surfactant comprises nonylphenol ethoxylate, said sequestrant comprises ethylene diamine tetraacetic acid, said amine comprises triethanol amine, said alcohol comprises propylene glycol, and said source of alkalinity comprises triethanolamine.

28. The alkaline antimicrobial lubricant concentrate composition comprising:

(a) from about 0.1 wt-% to 10 wt-% tall oil fatty acid;
(b) from about 5 wt-% to 30 wt-% coconut fatty acid;
(c) from about 5 wt-% to 20 wt-% quaternary ammonium compound;
(d) an amount of a source of alkalinity effective for neutralizing said fatting acids and increasing the pH of the composition above about 8, said alkalinity source selected from the group consisting of diethanolamine, triethanolamine, an alkali metal hydroxide, an alkali earth metal hydroxide, or mixtures thereof;
(e) a nonionic surfactant; and
(f) a balance of water wherein the lubricant is phase stable and chemically stable.

29. An alkaline antimicrobial lubricant concentrate composition comprising:

(a) from about 0.1 wt-% to 10 wt-% tall oil fatty acid;
(b) from about 5 wt-% to 30 wt-% lauric acid;
(c) from about 5 wt-% to 20 wt-% quaternary ammonium compound;
(d) an amount of a source of alkalinity effective for neutralizing said fatting acids and increasing the pH of the composition above about 8, said alkalinity source selected from the group consisting of diethanolamine, triethanolamine, an alkali metal hydroxide, an alkali earth metal hydroxide, or mixtures thereof;
(e) a nonionic surfactant; and
(f) a balance of water wherein the lubricant is phase stable and chemically stable.

* * * * *

UNITED STATES PATENT AND TRADEMARK OFFICE

CERTIFICATE OF CORRECTION

PATENT NO. : 5,244,589

DATED : September 14, 1993

INVENTOR(S) : Chung-Tsing Liu, et al

It is certified that error appears in the above-identified patent and that said Letters Patent is hereby corrected as shown below:

Column 13, claim 6, line 36, "about" should read --above--.

Column 14, claim 20, line 68, "about" should read --above--.

Column 14, claim 11, line 8, "baring" should read --bearing--.

Column 14, claim 15, line 26, "15" should read --20--.

Column 16, claim 29, line 27, "fatting" should read --fatty--.

Signed and Sealed this

Fifth Day of July, 1994

Bruce Lehman

BRUCE LEHMAN

*Commissioner of Patents and Trademarks*

*Attest:*

*Attesting Officer*